US006054662A

United States Patent [19]

Hrehor, Jr. et al.

[11] Patent Number: 6,054,662

[45] Date of Patent: Apr. 25, 2000

[54] TORSION ENHANCED RETURN DEVICE FOR ELECTRONIC SYSTEM PUSH BUTTON

[75] Inventors: Robert D. Hrehor, Jr.; Gilberto Hernandez, both of Round Rock, Tex.

[73] Assignee: Dell USA L.P., Round Rock, Tex.

[21] Appl. No.: 09/299,968

[22] Filed: Apr. 26, 1999

[51] Int. Cl.[7] ..... H01H 3/20

[52] U.S. Cl. ..... 200/332; 200/343

[58] Field of Search ..... 200/341–345, 200/329

[56] References Cited

U.S. PATENT DOCUMENTS

| | | | |
|---|---|---|---|
| 4,000,389 | 12/1976 | Misson et al. | 200/292 |
| 4,160,886 | 7/1979 | Wright et al. | 200/5 A |
| 4,252,114 | 2/1981 | Seres et al. | 128/205.16 |
| 4,315,114 | 2/1982 | Monti, Jr. | 200/5 A |
| 4,368,364 | 1/1983 | Harbers, Jr. | 200/6 R |
| 4,486,637 | 12/1984 | Chu | 200/340 |
| 4,904,549 | 2/1990 | Goodwin et al. | 429/97 |
| 5,144,103 | 9/1992 | Suwa | 200/344 |
| 5,193,667 | 3/1993 | Choi | 200/331 |
| 5,247,143 | 9/1993 | Suwa | 200/517 |
| 5,263,883 | 11/1993 | Kirayoglu | 439/856 |
| 5,560,118 | 10/1996 | Plummer | 33/709 |
| 5,739,486 | 4/1998 | Buckingham | 200/5 A |
| 5,749,457 | 5/1998 | Castaneda et al. | 200/343 |
| 5,788,060 | 8/1998 | Kuroda | 200/343 |
| 5,813,520 | 9/1998 | Reier et al. | 200/343 |

OTHER PUBLICATIONS

Robert D. Hrehor, Jr. and James D. Curlee; "Button With Flexible Cantilever"; Aug. 21, 1998; 09/137,730; 11 pages; 3 sheets of drawings (FIGS. 1A–4). (Copy Not Enclosed).

*Primary Examiner*—Michael L. Gellner
*Assistant Examiner*—Nhung Nguyen
*Attorney, Agent, or Firm*—Skjerven, Morrill, MacPherson Franklin & Friel, L.L.P.; David G. Dolezal

[57] ABSTRACT

A return device for an electronic system push button. The return device includes a torsion bar for storing torsion energy when a push button is moved from a non actuating position to an actuating position. The return device includes an arm extending from the torsion bar for receiving a user generated force on the push button and for providing a return force for the push button. One end is rotatably coupled to a housing panel and the other end is coupled to the panel to restrict rotation of the end with respect to the housing. In one example of a return device, the push button and an actuator are fixably coupled to the arm. The return device can be used with a variety of push buttons which perform different operations for an electronic system. For example, a return device may be utilized with a push button that actuates a panel retention mechanism of a housing.

41 Claims, 8 Drawing Sheets

TORSION ENHANCED RETURN DEVICE FOR ELECTRONIC SYSTEM PUSH BUTTON

BACKGROUND OF THE INVENTION

1. Field of the Invention

This invention relates in general to electronic systems and more specifically to return devices for electronic system push buttons.

2. Description of the Related Art

Computer systems are information handling electronic systems which can be designed to give independent computing power to one user or a plurality of users. Computer systems may be found in many forms including, for example, mainframes, minicomputers, workstations, servers, personal computers, internet terminals, notebooks, and embedded systems. Computer systems include desk top, floor standing, rack mounted, or portable versions. A typical computer system includes at least one system processor, associated memory and control logic, and a number of peripheral devices that provide input and output for the system. Such peripheral devices may include display monitors, keyboards, mouse-type input devices, floppy and hard disk drives, CD-ROM drives, printers, network capability cards, terminal devices, modems, televisions, sound devices, voice recognition devices, electronic pen devices, and mass storage devices such as tape drives, CD-R drives, or DVDs.

Electronic systems include push buttons for performing various functions such as controlling power to the system, entering user input into the system, and performing mechanical operations such as moving a retaining mechanism of the housing to a non retaining state to open the housing. Systems employing a push button typically include a return device for returning the push button to a non actuating position.

FIG. 1 is a partial perspective view of an inner side of an outer housing panel 103 having a prior art return device for providing a force to return a push button (not shown in FIG. 1) to a non actuated state. The return device shown in FIG. 1 includes a cantilever spring 105 with an actuator 107 located at the bottom end (relative to the view shown in FIG. 1) of cantilever spring 105 and a snap support 109 for mounting the return device to panel 103. A push button ( not shown) is located on the other side of cantilever spring 105 opposite actuator 107. When a user pushes the push button, actuator 107 travels in the direction of arrow 111 to move a surface (not shown) to perform an operation. When a user pushes the push button to move the push button to an actuating position to perform the desired operation, deformation energy is stored in cantilever spring 105 as actuator 107 is moved along line 111. When a user releases the push button, the energy stored in cantilever spring 105 is released to generate a force to move the push button and actuator 107 back to their non actuating positions shown in FIG. 1.

One problem with the return device of FIG. 1 is that cantilever spring 105 is required to be relatively long to provide the required travel for actuator 107 and still be within the stress parameters of the material from which cantilever 105 is made (such as an ABS plastic). With the increasing complexity of today's electronic systems, a more compact return device is desired.

SUMMARY OF THE INVENTION

It has been discovered that a return device that includes a bar for storing torsion energy advantageously provides the electronic system with a compact return device that generates a return force for an electronic system push button. Providing a return device with such a bar allows for increased travel of an actuator due to the rotational movement of the bar and also provides a structure in the return device to store torsion energy to generate a force for returning the push button and/or actuator to a non actuating position. Consequently, such a device may be conveniently mounted on the inner side of an outer panel of an electronic system housing.

In one aspect, the invention includes an apparatus for providing a return force for a push button. The apparatus includes a bar having a first portion and a second portion. The first portion defines a surface for receiving a corresponding collar surface fixably coupled to a housing to allow the first portion to rotate with respect to the housing during the movement of a push button between an actuating position and a non actuating position. The second portion is connected to an attachment mechanism to couple the second portion of the bar to the housing and to at least partially restrict the rotational movement of the second portion with respect to the housing. The apparatus also includes an arm extending from the first portion of the bar. The arm has a first portion for receiving a user generated force on a push button to move the push button from a non actuating position to an actuating position and for providing a second force for moving the push button from an actuating position to a non actuating position. The user generated force on the arm torsionally rotates the first portion of the bar with respect to the second portion of the bar to store torsion energy in the bar. A release of the stored torsion energy in the bar generates at least a portion of the second force.

In another aspect of the invention, a computer system includes a housing, a push button, and a return device. The return device includes a bar having a first portion and a second portion. The first portion is rotatably coupled to the housing. The second portion is coupled to the housing such that a rotational movement of the second portion with respect to the housing is at least partially restricted. The return device also includes an arm extending from the first portion of the bar. The arm has a first portion for receiving a user generated force on the push button to move the push button from a non actuating position to an actuating position and for providing a second force for moving the push button from an actuating position to a non actuating position. The user generated force on the arm torsionally rotates the first portion of the bar with respect to the second portion of the bar to store torsion energy in the bar. A release of the stored torsion energy in the bar generates at least a portion of the second force.

In another aspect of the invention, a computer system includes a housing, a push button, and a return device. The return device includes a bar having a first portion and a second portion, means for rotationally coupling the first portion of the bar to the housing, and means for coupling the second portion of the bar to at least partially restrict the rotational movement of the second portion with respect to the housing. The return device also includes means for receiving a user generated force on the push button to move the push button from a non actuating position to an actuating position and means for providing a second force for moving the push button from an actuating position to a non actuating position. The user generated force torsionally rotates the first portion of the bar with respect to the second portion of the bar to store torsion energy in the bar. A release of the stored torsion energy in the bar generates at least a portion of the second force.

In another aspect of the invention, a computer system includes a housing, a push button accessible from an outer side of the housing, and a return device mounted to an inner side of an outer panel of the housing. The return device further includes a bar having a first portion and a second portion and an arm extending from the first portion of the bar. The arm has a first portion for receiving a user generated force on the push button to move the push button from a non actuating position to an actuating position. The user generated force on the arm torsionally rotates the first portion of the bar with respect to the second portion of the bar to store torsion energy in the bar.

In another aspect of the invention, a computer system includes a housing, a push button, and a return device. The return device includes a bar having a first portion and a second portion. The first portion is rotatably coupled to the housing. The second portion is coupled to the housing such that a rotational movement of the second portion with respect to the housing is at least partially restricted. The return device also includes an actuator for contacting an actuating surface of a device located in the housing to provide an actuating force on the actuating surface. A user generated force on the push button moves the actuator from a non actuating position to an actuating position to provide the actuating force on the actuating surface. The return device further includes an arm extending from the first portion of the bar. The arm has a first portion for receiving a user generated force on the push button to move the push button from a non actuating position to an actuating position and for providing a second force for moving the actuator from an actuating position to a non actuating position. The user generated force on the arm torsionally rotates the first portion of the bar with respect to the second portion of the bar to store torsion energy in the bar. A release of the stored torsion energy in the bar generates at least a portion of the second force.

In another aspect of the invention, a computer system includes a housing, a push button, and a return device. The return device includes a bar having a first portion and a second portion. The first portion is rotatably coupled to the housing. The second portion is coupled to the housing such that a rotational movement of the second portion with respect to the housing is at least partially restricted. The return device also includes an arm extending from the first portion of the bar. The push button is fixably coupled to the arm. The return device further includes an actuator fixably coupled to the arm to provide an actuating force on an actuating surface of a device located in a housing.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates identical items unless otherwise noted.

DETAILED DESCRIPTION

The following sets forth a detailed description of a mode for carrying out the invention. The description is intended to be illustrative of the invention and should not be taken to be limiting.

Figure 2:
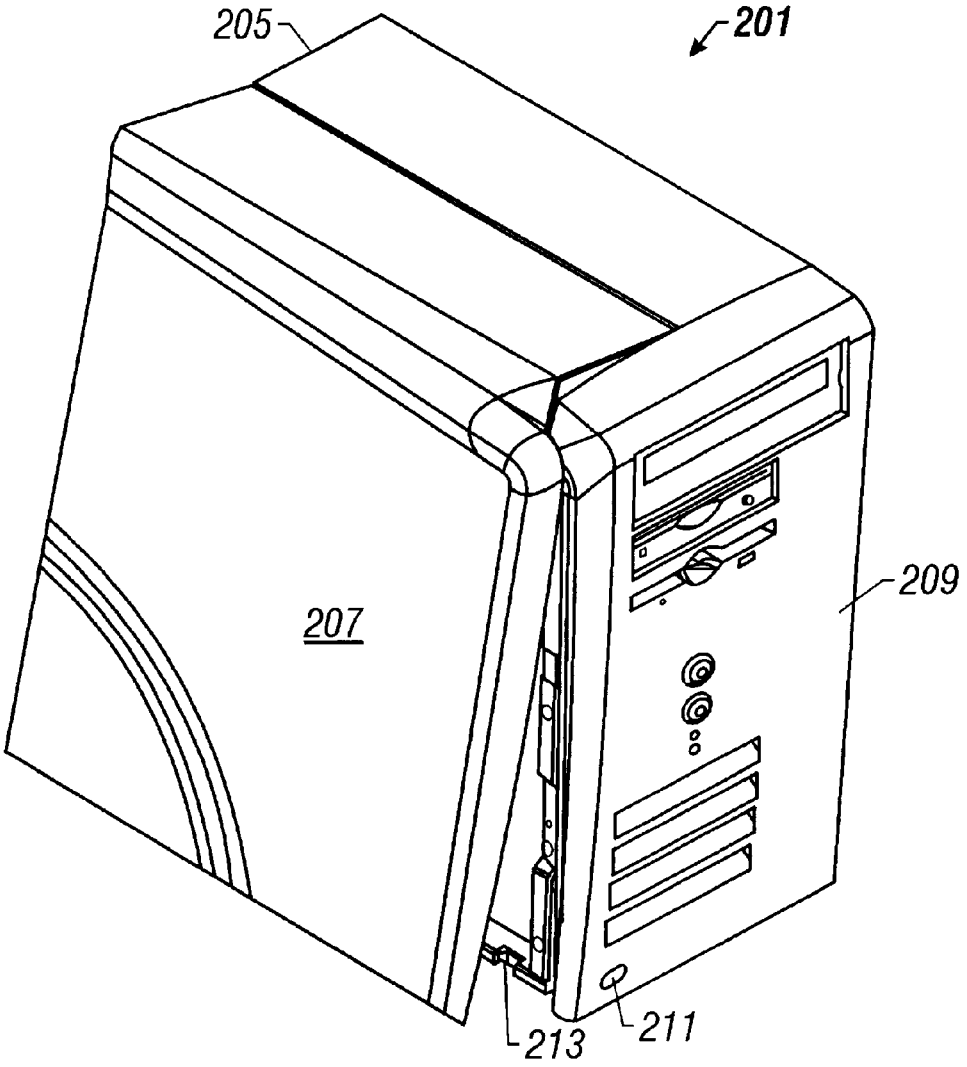
FIG. 2 is a perspective view of an electronic system.

FIG. 2 is a perspective view of an electronic system. The electronic system shown in FIG. 2 is a personal computer system 201. Computer components of computer system 201 such as a system processor (not shown), memory (not shown), and peripheral devices (not shown) are housed in housing 205. Housing 205 includes a number of panels such as side panel 207 and a front bezel panel 209.

Computer system 201 includes a push button 211 accessible from the front of computer system 201. Computer system 201 includes a retention mechanism (see FIG. 8) having retaining surfaces (such as a surface located on sliding hook 213) that, when the retention mechanism is in a retaining state and when panel 207 is properly positioned against frame structures (not shown) of housing 205, act to retain corresponding hooks (items 805 of FIG. 8) of panel 207 to retain panel 207 to the frame structures of housing 205. Moving push button 211 from its non actuating position shown in FIG. 2 to an actuating position moves sliding hooks 213 away from retaining hooks 805 (see FIG. 8) to a non retaining position where panel 207 can be removed to an open position such as that shown in FIG. 2 or such as completely removed from computer system 201. Moving panel 207 to an open position provides a user with access to computer components (e.g. system processor, memory chips, add-in cards, etc.) housed in housing 205.

Figure 3:
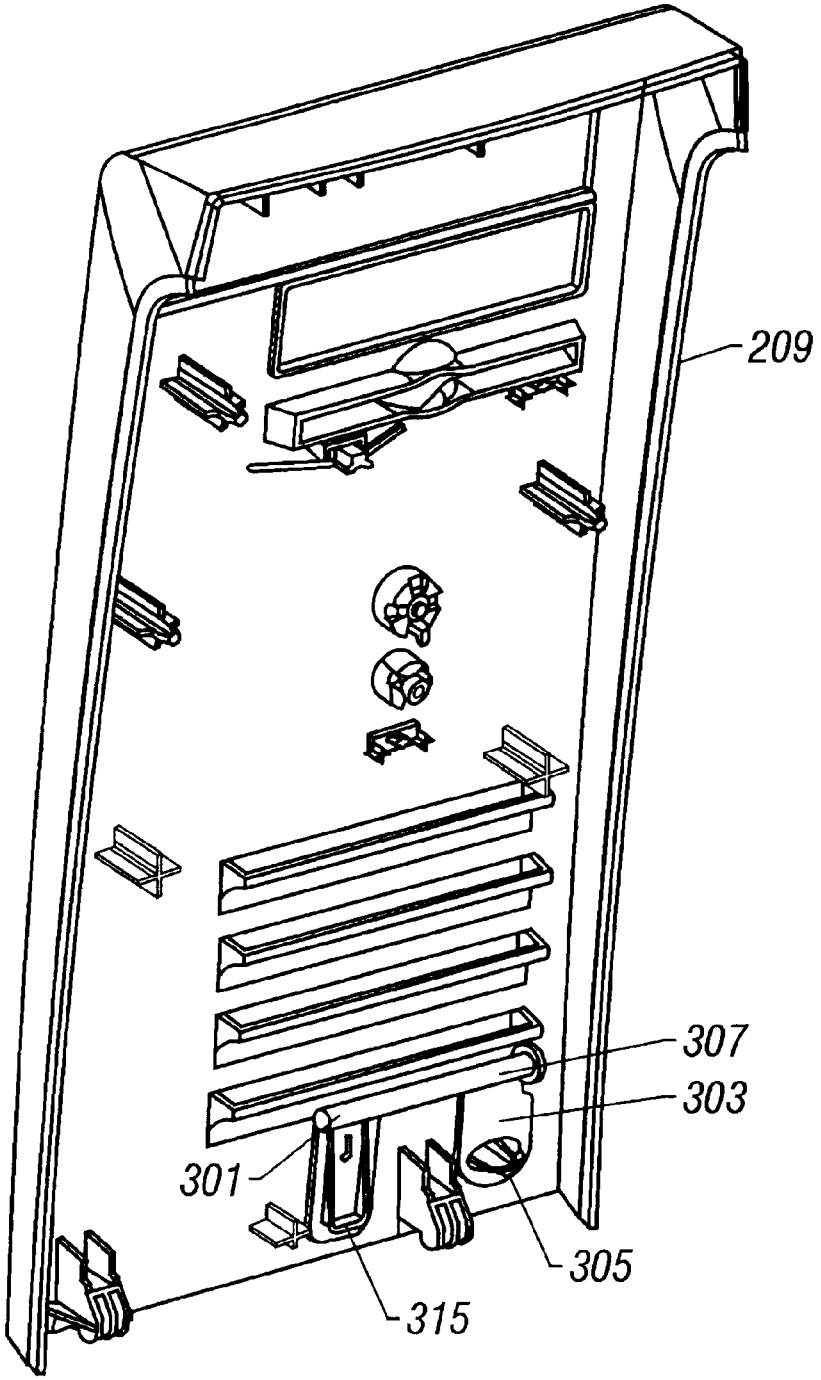
FIG. 3 is a perspective view of a return device mounted on an inner side of an electronic system housing panel according to the present invention.

FIG. 3 is a perspective view of an inner side of panel 209. Mounted to the inner side of panel 209 is a return device 301. Return device 301 includes a torsion bar 307 (bar 307) that stores torsion energy when push button 211 (located on the back side of arm 303) is moved to an actuating position by a user. A release of the torsion energy stored in bar 307 when the user releases push button 211 generates a force to move push button 211 back to its non actuating position as shown in FIG. 2. Return device 301 also includes an actuator 305 that, when push button 211 is moved to an actuating position, travels inward with respect to the computer system to move an actuating surface of a computer system device (e.g., actuation plate 807 of FIG. 8) to actuate a desired operation such as the release of panel hooks 805 by sliding hooks 213. Other electronic systems may utilize push buttons to activate and deactivate power supplies and to provide user input such as with key pad number buttons. Accordingly, return devices according to the present invention may also be utilized to provide a return force with such push buttons.

Return device 301 also includes a snap support attachment member 315 for coupling the left end of bar 307, relative to the view shown in FIG. 3, to panel 209. Snap support 315 restricts the rotational movement of the left end of bar 307 allowing for torsion energy to be stored in bar 307 when push button 211 is moved to an actuating position.

Figure 4A:
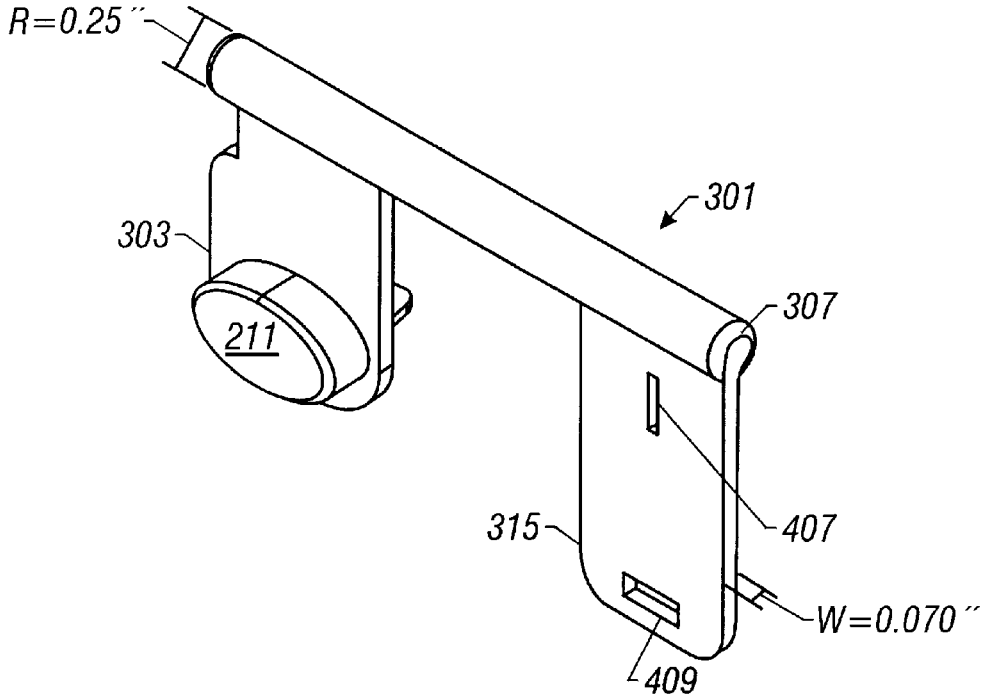
FIGS. 4A and 4B show perspective views of a return device according to the present invention.
Figure 4B:
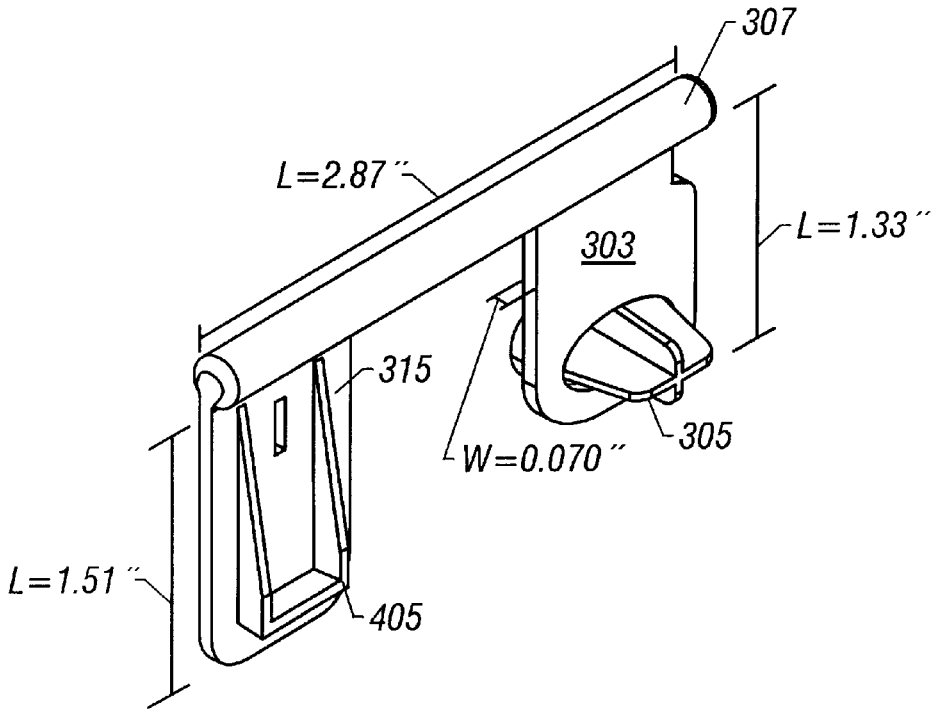

FIGS. 4A and 4B show perspective views of return device 301. Also shown in FIGS. 4A and 4B are the width and length dimensions of arm 303 and snap support 315 and the length and diameter dimensions of bar 307. It is understood that other return devices may have different values for these dimensions.

Support snap 315 also includes a rib structure 405 for providing support against deformation when push button 211 is being moved to an actuating position from a non actuating position. However, attachment members for other return devices do not include a support structure preventing deformation. With some return devices, deformation energy is stored in the attachment member when the push button is moved from a non actuating position to an actuating position.

Return device 301 is integrally formed from an ABS plastic material by conventional methods such as injection molding. Consequently, bar 307, arm 303, push button 211, and snap support 315 are all integrally connected. Providing an electronic system with an integrally connected return device simples the assembly of the electronic system in that only one part is installed to the housing. However, other return devices may be assembled from separately formed pieces. Also, other return devices may include portions or be entirely formed from other materials such as polycarbonate plastics, polycarbonate ABS plastics, or other types of plastics or may be formed from metals.

Figure 5:
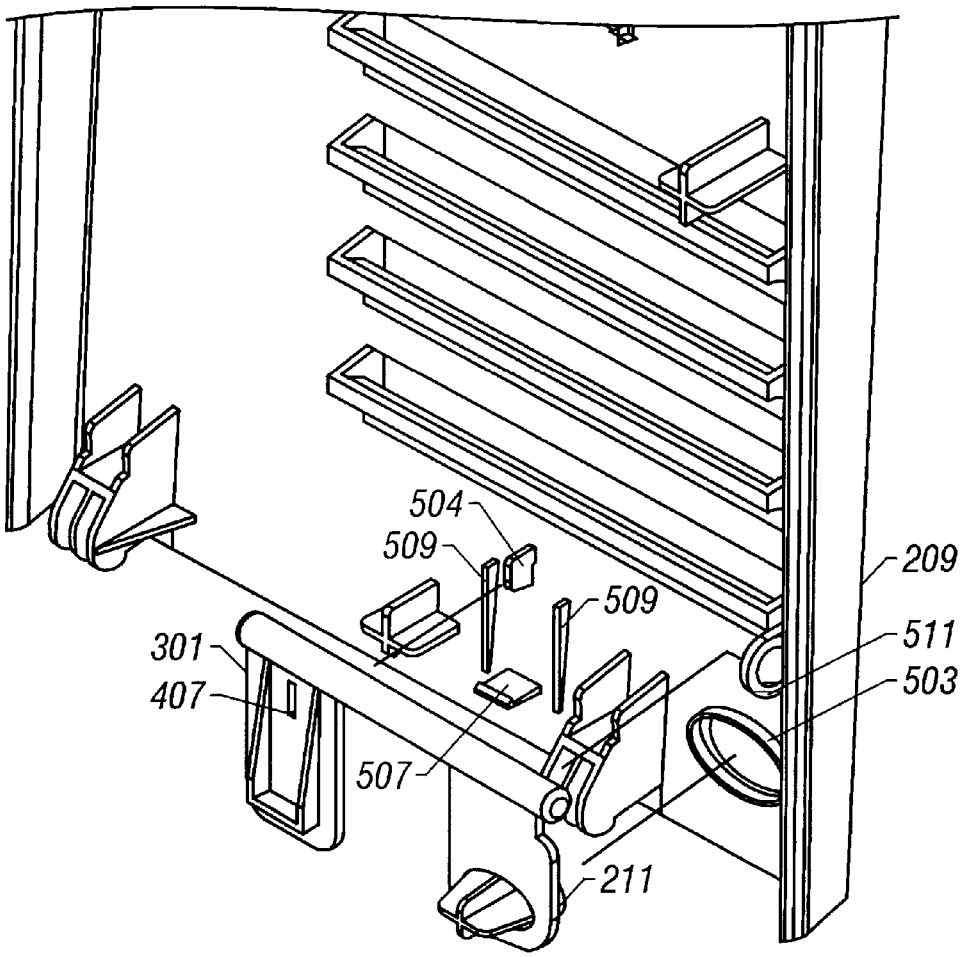
FIG. 5 is a partial perspective view of an inner side of an electronic system housing panel and a return device showing installment lines for installing the return device to the inner side of the electronic system housing panel according to the present invention.

FIG. 5 is a partial perspective view of the inner side of panel 209. FIG. 5 also shows return device 301 in a free standing orientation with superimposed installing lines for installing return device 301 to panel 209. Panel 209 includes an aperture 503 in which push button 211 extends through to be accessible from the outer side (not shown in FIG. 5) of panel 209. Located on the inner side of panel 209 are two attachment projections, snap 504 and snap 507, that extend through slots 407 and 409 (see FIG. 4A), respectively, and engage surfaces of snap support 315 to attach snap support 315 to the inner side of panel 209. Also attached to the inner side of panel 209 are alignment guides 509 that prevent lateral movement of snap support 315 with respect to panel 209 when the return device 301 is attached to panel 209 (as shown in FIG. 3).

Attached to the inner side of panel 209 is a collar 511 that receives a portion of the right end of bar 307, relative to the view shown in FIG. 5, to rotatably couple the right end of bar 307 to panel 209. Collar 511 is a closed collar in that it completely encircles a radial portion of bar 307. However, open collars may be utilized with some return devices. Also, some collars may have a capped end wherein the right end of bar 307, relative to the view shown in FIG. 5, is not exposed when bar 307 is engaged with the collar. Coupling the right end of bar 307, relative to the view shown in FIG. 5, with a collar allows the right end to rotate with respect to panel 209 when a user force is applied to push button 211.

To install return device 301 to panel 209, the right end of bar 307, relative to the view shown in FIG. 5, is inserted into collar 511. Slots 407 and 409 of snap support 315 are then aligned with snaps 504 and 507, respectively, wherein a force on snap support 315 towards the inner side of panel 209 attaches snap support 315 to the inner side of panel 209.

Figure 6:
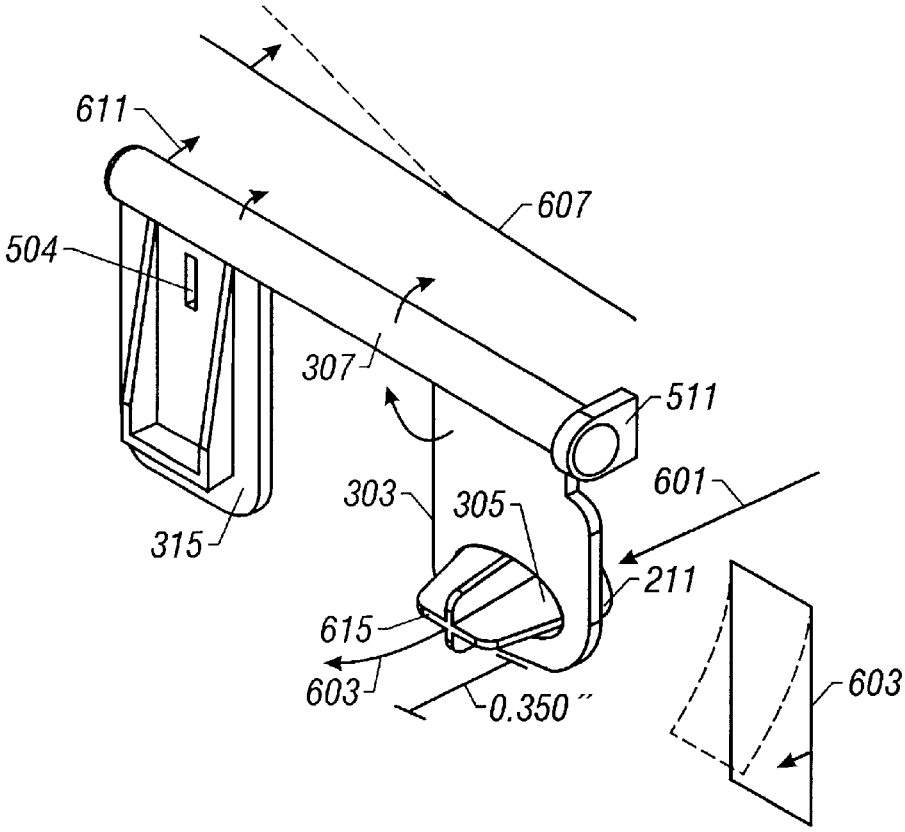
FIG. 6 is a perspective view of a return device showing forces operating on structures of the return device according to the present invention.

FIG. 6 is a perspective view of return device 301 showing forces operating upon the structures of return device 301 during the movement of push button 211. In FIG. 6, return device 301 is shown in a non actuating position. Other than collar 511 and snap 504, the structures of panel 209 are not shown in FIG. 6.

A user applying a force 601 on push button 211 moves arm 303 and actuator 305 inward as shown by arrow 603. User generated force 601 torsionally rotates the right side of bar 307, relative to the view shown in FIG. 6, with respect to the left side of bar 307 to torsionally deform bar 307 to store torsion energy in bar 307. When a user ceases in applying force 601 to push button 211, the torsion energy stored in bar 307 is released and generates a force (not shown in FIG. 6) to rotate arm 303 back to its position shown in FIG. 6.

The left side of bar 307, relative to the view shown in FIG. 6, is coupled to panel 209 (not shown in FIG. 6) via snap support 315 and snaps 504 and 507 (not shown in FIG. 6) to restrict the rotational movement of the left side of bar 307 with respect to panel 209, thereby allowing torsion energy to be stored in bar 307. With some return devices, the attachment of the left side of bar 307, relative to the view shown in FIG. 6, may have some "play" such that the left end of bar 307 may rotate somewhat with respect to panel 209 when user generated force 601 is being applied. However, with these return devices, the rotation of the right side of bar 307, relative to the view shown in FIG. 6, is significantly greater than the rotation of the left side of bar 307 such that torsion energy is stored in bar 307 by the user generated force 601.

In addition to storing torsion energy, user generated force 601 also stores energy in other structures of return device 301, that when released, generate forces to return push button 211 and actuator 305 back to their non actuating positions. For example, user generated force 601 also stores deformation energy in arm 303 such that arm 303 acts as a cantilever spring. Diagram 603 illustrates the deformation of arm 303 that is caused by user generated force 601, wherein the dashed lines represent the position of arm 303 when push button 211 is in the actuating position. As shown in diagram 603, user generated force 601 on push button 211 moves the bottom portion of arm 303, relative to the view shown in FIG. 6, with respect to the top portion of arm 303 to store deformation energy in arm 303. When a user ceases in applying force 601 to push button 211, the deformation energy that is stored in arm 303 is released and generates a force (not shown in FIG. 6) that, in combination with the force generated by the stored torsion energy in bar 307, moves push button 211 and actuator 305 back to their non actuating positions shown in FIG. 6.

With some return devices, user generated force 601 also stores deformation energy in torsion bar 307. As shown in diagram 607, user generated force 601 moves the left end of bar 307, relative to the view shown in FIG. 6, in direction 611 direction to store deformation energy in torsion bar 307. When a user ceases applying force 601 to push button 211, the deformation energy that is stored in torsion bar 307 is released and generates a force (not shown in FIG. 6) that, in combination with the forces generated by the stored torsion energy in bar 307 and the deformation energy stored in arm 303, moves push button 211 and actuator 305 back to their non actuating positions shown in FIG. 6. Deformation energy is stored in torsion bar 307 because the attachment of the left end of bar 307, relative to the view shown in FIG. 6, allows for movement in direction 611. However, other types of return devices only store torsion energy in bar 303.

Other push button devices may include an attachment member (similar to snap support 315) that is resiliently bendable. With such devices, user generated force 601 may deform the bendable attachment member to store deformation energy in the attachment member. When a user ceases in applying force 601 to push button 211, the deformation energy that is stored in the bendable attachment member is released and generates a force (not shown in FIG. 6) that, in combination with the forces generated from the other stored energies in return device 301, moves push button 211 and actuator 305 back to their positions shown in FIG. 6. A diagram showing the deformation of an attachment member is not shown in FIG. 6.

Figure 1:
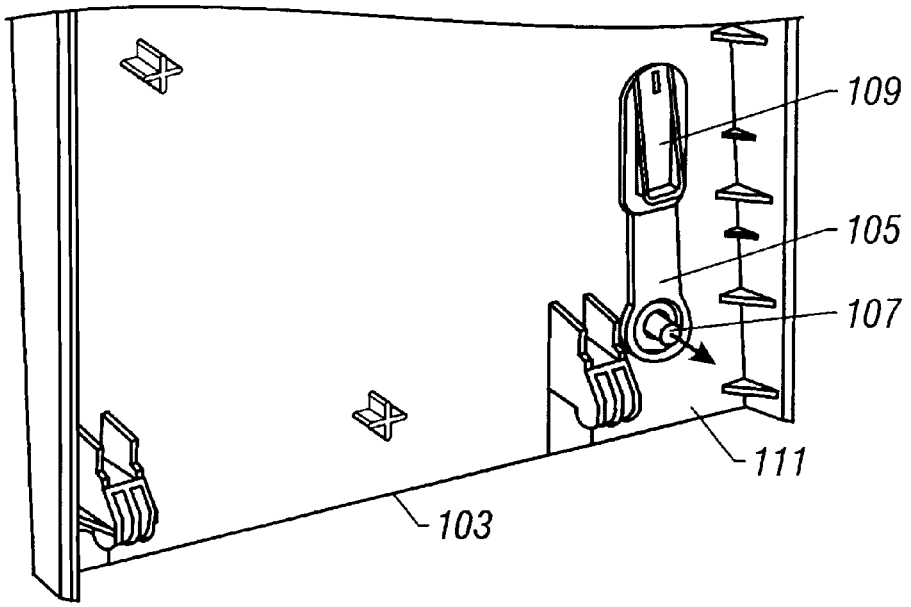
FIG. 1 (Prior Art)
FIG. 1 is partial perspective view of a prior art return device mounted on an inner side of an electronic system housing panel.

In FIG. 6, the inward end 615 of actuator 305 is required to travel 0.350 inches in order to place the retaining mechanism in a non retaining state from a retaining state. An advantage of return device 301 is that travel of actuator 305 can be obtained from the torsional angle of displacement of bar 307. Thus, the amount of deformation of arm 303 required to obtain the necessary actuator travel is significantly less than, for example, cantilever spring 105 of FIG. 1. Because there is less deformation required, the stress requirements of arm 303 are also reduced, thereby allowing arm 303 to have a significantly shorter length.

Another advantage of return device 301 is that the same torsional angle of displacement allowing for greater actuator travel also stores torsional energy (as previously described) to generate a return force for push button 211 and actuator 305.

Those skilled in the art will appreciate that, based upon the teachings herein, a return device according to the present invention may have other forms, shapes, and dimensions other than those shown in FIGS. 2–6 and described in the specification. For example, arm 303, actuator 305, push button 211, torsion bar 307, and attachment mechanism may have other shapes, forms, lengths and widths.

Figure 7:
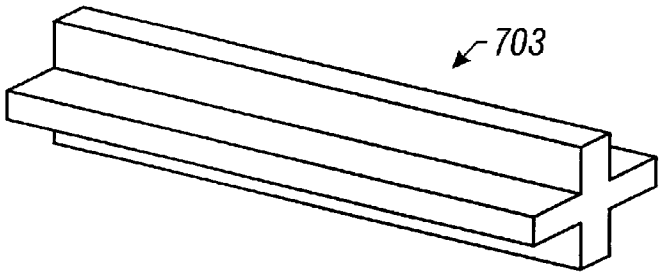
FIG. 7 is a perspective view of another embodiment of a torsion bar according to the present invention.

For example, FIG. 7 shows an embodiment of a torsion bar having a "cross" cross-sectional shape. Its cross cross-sectional shape makes torsion bar 703 easier to mold and/or machine. In addition, the cross cross-sectional shape allows bar 703 to more easily torsionally rotate.

Referring back to FIG. 6, the amount of travel of actuator 305 can be increased by increasing the length of arm 303 or by increasing the length of torsion bar 307. Increasing the length of torsion bar 307 allows for an increased angle of twist of bar 307 without increasing the stress on torsion bar 307. The angle of twist (θ) for a return device having a cylindrical bar is approximately:

$$\theta \cong \frac{\tau * L}{G * r}$$

wherein τ is the torsional stress on the bar, r is the radius of the bar, L is the length of the bar, and G is the modulus of rigidity of the bar material.

Using material with a higher resiliency allows the lengths and widths of the torsion bar and arm to be reduced. Materials with a high yield stress and relatively low modulus of elasticity are preferable.

Figure 9:
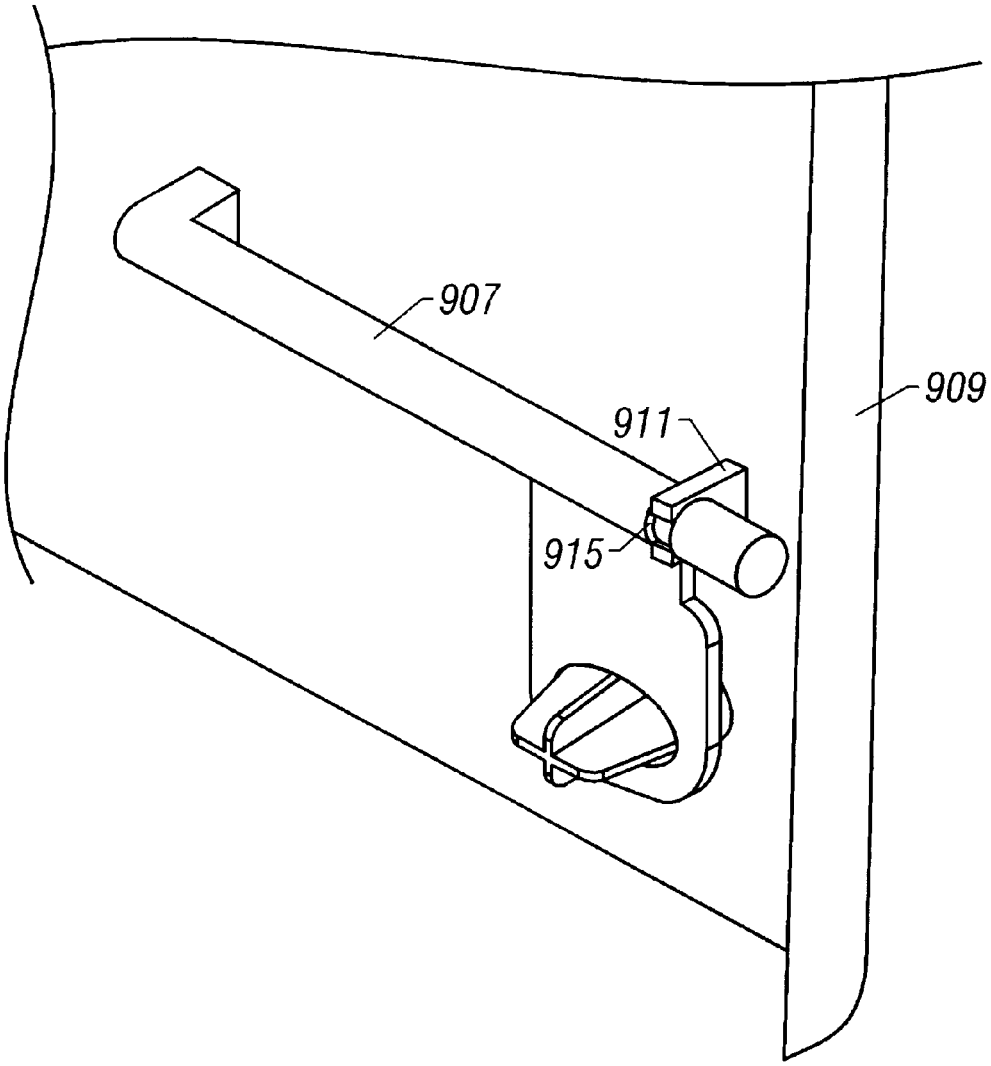
FIG. 9 is a partial perspective view of another embodiment of an inner side of an electronic system housing panel according to the present invention.

Referring back to FIG. 3, attachment member 315 may be attached to panel 209 by other attaching devices or techniques such as by rivets or screws. With other return devices, the left end of bar 307, relative to the view shown in FIG. 3, may be integrally connected to the outer panel. Also, the left end of bar 307, relative to the view shown in FIG. 3, may be fixably coupled to panel 209 such that the left end does not move with respect to panel 209. FIG. 9 is a partial perspective view of an inner side of another example of an electronic system housing panel 909 where the left end of bar 907, relative to the view shown in FIG. 9, is fixably coupled to housing panel 909. The right end of bar 907, relative to the view shown in FIG. 9, includes a groove 915 and is rotatably coupled to panel 909 via open collar 911 of which a portion is received in groove 915.

Figure 8:
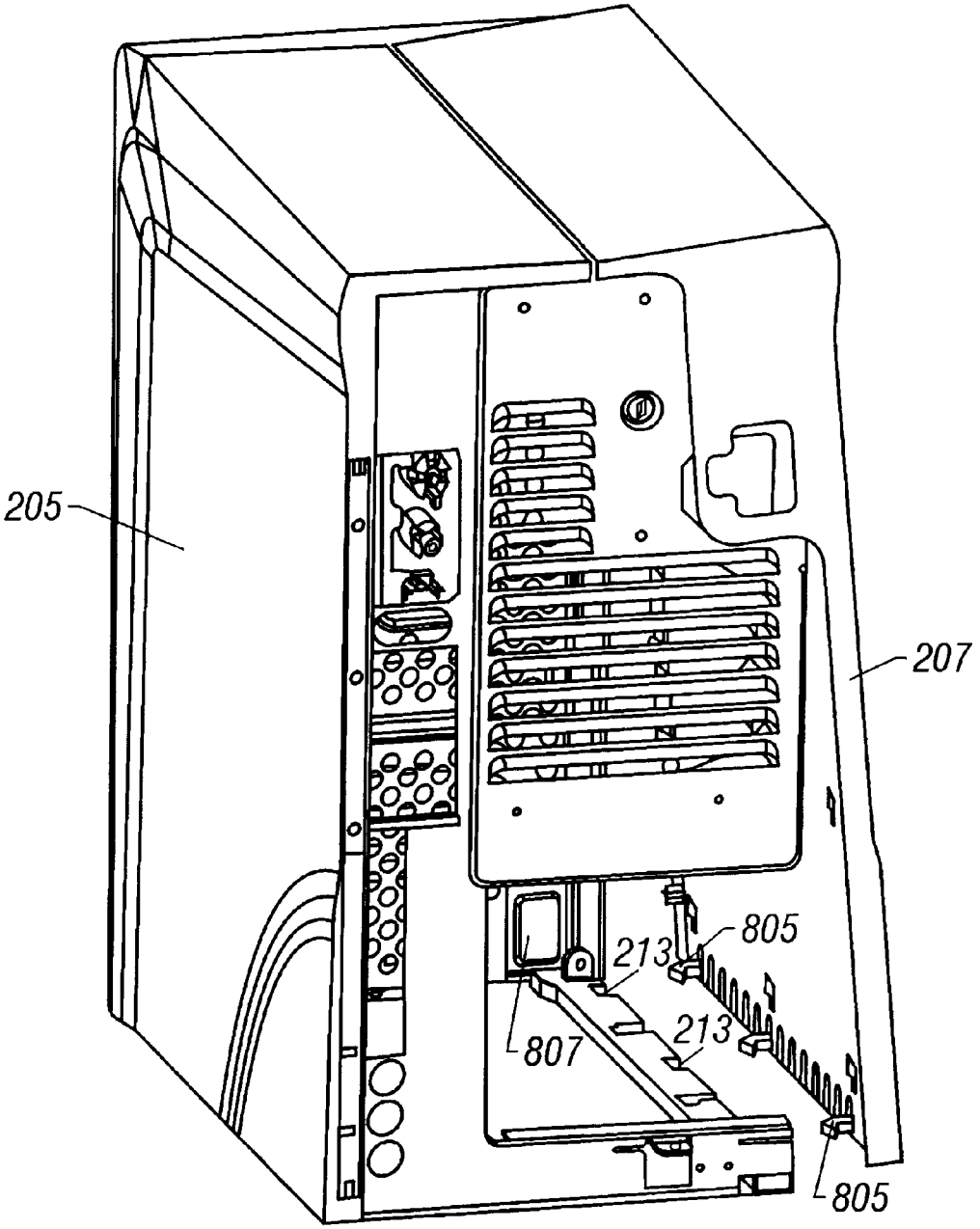
FIG. 8 is a perspective view of a backside of a partially opened electronic system housing.

FIG. 8 is a perspective view of a backside of housing 205. The retaining mechanism of housing 205 includes an actuator plate 807. When push button 211 (not shown in FIG. 8) is moved to an actuating position, actuator 305 (not shown in FIG. 8) moves actuator plate 807 inwards to place the retaining mechanism in a non retaining state. The movement of actuator plate 807 moves sliding hooks 213 away from retaining hooks 805 to a non retaining position where panel 207 is not retained by the retaining mechanism. The retaining mechanism of computer system 201 is a sliding hook type of retaining mechanism such as can be found in the OPITPLEX MINITOWER computer system sold by DELL COMPUTER CORP. The retaining mechanism of computer system 201 may also be referred to as a biased cover latching mechanism. With other electronic systems, other types of retaining mechanisms may be utilized.

A return device may be utilized with other types of electronic systems such as other forms of computer systems according to the present invention. Furthermore, the return device may be attached to other structures of an electronic device.

While particular embodiments of the present invention have been shown and described, it will be recognized to those skilled in the art that, based upon the teachings herein, further changes and modifications may be made without departing from this invention and its broader aspects, and thus, the appended claims are to encompass within their scope all such changes and modifications as are within the true spirit and scope of this invention.

What is claimed is:

1. An apparatus for providing a return force for a push button, the apparatus comprising:

a bar having a first portion and a second portion, the first portion defining a surface for receiving a corresponding collar surface fixably coupled to a housing to allow the first portion to rotate with respect to the housing during the movement of a push button between an actuating position and a non actuating position, the second portion connected an attachment mechanism to couple the second portion of the bar to the housing and to at least partially restrict the rotational movement of the second portion with respect to the housing;

an arm extending from the first portion of the bar, the arm having a first portion for receiving a user generated force on a push button to move the push button from a non actuating position to an actuating position and for providing a second force for moving the push button from an actuating position to a non actuating position;

wherein the user generated force on the arm torsionally rotates the first portion of the bar with respect to the second portion of the bar to store torsion energy in the bar, wherein a release of the stored torsion energy in the bar generates at least a portion of the second force.

2. The apparatus of claim 1 wherein the surface for receiving a collar surface is located in groove defined in the first portion of the bar.

3. The apparatus of claim 1 wherein the push button is fixably coupled to the arm.

4. The apparatus of claim 3 wherein the push button is integrally connected to the arm.

5. The apparatus of claim 1 wherein the attachment mechanism includes an attachment member extending from the second portion of the bar, the attachment member including at least one surface for attaching the attachment member to a housing.

6. The apparatus of claim 5 wherein the attachment member extends from the bar in a first orientation, wherein the arm extends from the bar in an orientation that is generally the same as the first orientation.

7. The apparatus of claim 1 wherein the attachment mechanism includes a attachment member extending from the second portion of the bar, the attachment member defining at least one aperture in the attachment member for receiving at least one attachment projection of a housing structure, respectively to attach the attachment member to the housing.

8. The apparatus of claim 7 wherein the at least one aperture includes at least one slot.

9. The apparatus of claim 1 wherein the arm is resiliently bendable such that the user generated force moves an end of the arm located furthest from the bar with respect to the end of the arm located at the bar to store deformation energy in the arm, wherein a release of the stored deformation energy in the arm generates at least a portion of the second force.

10. The apparatus of claim 1 further comprising:

an actuator fixably coupled to the arm to provide an actuating force on an actuating surface of a device located in a housing utilizing the user generated force.

11. The apparatus of claim 10 wherein the actuator is integrally connected to the arm.

12. The apparatus of claim 10 wherein the actuator is integrally connected to the push button.

13. The apparatus of claim 1 where the user generated force moves an end of the bar located at the second portion with respect to an end of the bar at the first portion to store deformation energy in the bar, wherein a release of the stored deformation energy in the bar generates at least a portion of the second force.

14. The apparatus of claim 1 wherein the bar has a cross-sectional shape, wherein the cross section shape of the bar is of a cross form.

15. The apparatus of claim 1 wherein the attachment member and the bar are integrally connected.

16. A computer system comprising:

a housing;

a push button;

a return device including:

a bar having a first portion and a second portion, the first portion being rotatably coupled to the housing, the second portion being coupled to the housing such that a rotational movement of the second portion with respect to the housing is at least partially restricted;

an arm extending from the first portion of the bar, the arm having a first portion for receiving a user generated force on the push button to move the push button from a non actuating position to an actuating position and for providing a second force for moving the push button from an actuating position to a non actuating position;

wherein the user generated force on the arm torsionally rotates the first portion of the bar with respect to the second portion of the bar to store torsion energy in the bar, wherein a release of the stored torsion energy in the bar generates at least a portion of the second force.

17. The computer system of claim 16 wherein the housing further includes:

a retaining mechanism that in a retention state, positions at least one retaining surface in a retaining position to retain at least one panel of the housing to another portion of the housing, wherein in a non retention state, the retaining mechanism positions the at least one retaining surface in a non retaining position with respect to the at least one panel;

wherein movement of the push button from a non actuating position to an actuating position places the retaining mechanism in a non retaining state from a retaining state.

18. The computer system of claim 17 wherein the return device further includes:

an actuator located on the arm for contacting the an actuating surface of the retaining mechanism, wherein movement of the push button to an actuating position moves the actuator to move the actuating surface of the retaining mechanism to place the retaining mechanism in a non retaining state from a retaining state.

19. The computer system of claim 18 wherein the actuator, the arm, and the bar are integrally connected.

20. The computer system of claim 16 wherein the push button and the arm are fixably coupled.

21. The computer system of claim 20 wherein the push button and the arm are integrally connected.

22. The computer system of claim 16 wherein the housing includes an outer panel having a collar fixably coupled to an inner side of the outer panel, the first portion defines a radial surface engaged with the collar to allow the bar to rotate with respect to the outer panel.

23. The computer system of claim 22 wherein the collar is integially connected to the outer panel.

24. The computer system of claim 16 wherein the outer panel defines an aperture, wherein the push button extends through the aperture to the outer side of the outer panel.

25. The computer system of claim 16 wherein the retaining mechanism further includes an attachment member extending from the second portion of the bar, the attachment member including at least one surface for attaching the attachment member to the housing.

26. The computer system of claim 16 wherein the attachment member and the bar are integrally connected.

27. The computer system of claim 16 wherein the arm is bendable such that the user generated force moves an end of the arm located furthest from the bar with respect to the end of the arm located at the bar to store deformation energy in the arm, wherein a release of the stored deformation energy in the arm generates at least a portion of the second force.

28. The computer system of claim 16 wherein the user generated force moves an end of the bar located at the second portion with respect to an end of the bar of the first portion to store deformation energy in the bar, wherein a release of the stored deformation energy in the bar generates at least a portion of the second force.

29. The computer system of claim 16 wherein an end of the second portion of the bar is fixably coupled to the housing.

30. The computer system of claim 16 wherein the return device is integrally connected.

31. A computer system comprising:

a housing;

a push button;

a return device including:

a bar having a first portion and a second portion;

means for rotationally coupling the first portion of the bar to the housing;

means for coupling the second portion of the bar to at least partially restrict the rotational movement of the second portion with respect to the housing;

means for receiving a user generated force on the push button to move the push button from a non actuating position to an actuating position;

means for providing a second force for moving the push button from an actuating position to a non actuating position;

wherein the user generated force torsionally rotates the first portion of the bar with respect to the second portion of the bar to store torsion energy in the bar, wherein a release of the stored torsion energy in the bar generates at least a portion of the second force.

32. A computer system comprising:

a housing;

a push button accessible from an outer side of the housing;

a return device mounted to an inner side of an outer panel of the housing, the return device further including:

a bar having a first portion and a second portion;

an arm extending from the first portion of the bar, the arm having a first portion for receiving a user generated force on the push button to move the push button from a non actuating position to an actuating position;

wherein the user generated force on the arm torsionally rotates the first portion of the bar with respect to the second portion of the bar to store torsion energy in the bar;

wherein the housing further includes:

a retaining mechanism that in a retention state, positions at least one retaining surface in a retaining position to retain at least one panel of the housing to another portion of the housing, wherein in a non retention state, the retaining mechanism positions the at least one retaining surface in a non retaining position with respect to the at least one panel;

wherein movement of the push button from a non actuating position to an actuating position places the retaining mechanism in a non retaining state from a retaining state.

33. The computer system of claim 32 wherein the return device further includes:

an actuator located on the arm for contacting an actuating surface of the retaining mechanism, wherein movement of the push button to an actuating position moves the actuator to move the actuating surface of the retaining mechanism to place the retaining mechanism in a non retaining state from a retaining state.

34. The computer system of claim 32 wherein the push button and the arm are fixably coupled.

35. The computer system of claim 32 wherein the outer panel includes a bezel.

36. The computer system of claim 32 wherein the return device is integrally connected.

37. A computer system comprising:

a housing;

a push button;

a return device including:

a bar having a first portion and a second portion, th e first portion being rotatably coupled to the housing, the second portion being coupled to the housing such that a rotational movement of the second portion with respect to the housing is at least partially restricted;

an actuator for contacting an actuating surface of a device located in the housing to provide an actuating force on the actuating surface, where in a user generated force on the push button moves the actuator from a non actuating position to an actuating position to provide the actuating force on the actuating surface;

an arm extending from the first portion of the bar, the arm having a first portion for receiving a user generated force on the push button to move the push button from a non actuating position to an actuating position and for providing a second force for moving the actuator from an actuating position to a non actuating position;

wherein the user generated force on the arm torsionally rotates the first portion of the bar with respect to the second portion of the bar to store torsion energy in the bar, wherein a release of the stored torsion energy in the bar generates at least a portion of the second force.

38. The computer system of claim 37 wherein the device located in the housing further includes:

a retaining mechanism that in a retention state, positions at least one retaining surface in a retaining position to retain at least one panel of the housing to another portion of the housing, wherein in a non retention state, the retaining mechanism positions the at least one retaining surface in a non retaining position with respect to the at least one panel;

wherein movement of the push button from a non actuating position to an actuating position moves the actuator to move the actuating surface to place the retaining mechanism in a non retaining state from a retaining state.

39. The computer system of claim 37 wherein the actuator, the arm, and the bar are integrally connected.

40. A computer system comprising:

a housing;

a push button;

a return device including:

a bar having a first portion and a second portion, the first portion being rotatably coupled to the housing, the second portion being coupled to the housing such that a rotational movement of the second portion with respect to the housing is at least partially restricted;

an arm extending from the first portion of the bar, the push button fixably coupled to the arm; and an actuator fixably coupled to the arm to provide an actuating force on an actuating surface of a device located in a housing.

41. The computer system of claim 40 wherein the push button and the return device are integrally connected.

* * * * *

UNITED STATES PATENT AND TRADEMARK OFFICE
CERTIFICATE OF CORRECTION

PATENT NO. : 6,054,662
ISSUE DATE : April 25, 2000
INVENTOR(S) : Hernandez, Gilberto; Hrehor Jr., Robert D.

It is certified that error appears in the above-identified patent and that said Letters Patent is hereby corrected as shown below:

Column 10, Line 12, after –contracting– delete –the–.
Column 11, Line 58, delete –th e– and insert "the".

Signed and Sealed this

Tenth Day of April, 2001

*Attest:*

Nicholas P. Godici

NICHOLAS P. GODICI

*Attesting Officer*

*Acting Director of the United States Patent and Trademark Office*